United States Patent [19]

Shah et al.

[11] 4,375,858

[45] Mar. 8, 1983

[54] CHILD RESISTANT CLOSURE DEVICE

[75] Inventors: Hemant D. Shah, Bombay, India; Laurence Edzenga, Passaic, N.J.

[73] Assignee: American Cyanamid Company, Stamford, Conn.

[21] Appl. No.: 319,180

[22] PCT Filed: Apr. 3, 1981

[86] PCT No.: PCT/US81/00435

§ 371 Date: Nov. 2, 1981

§ 102(e) Date: Nov. 2, 1981

[51] Int. Cl.[3] ..... B65D 55/02

[52] U.S. Cl. ..... 215/217; 215/216; 215/222

[58] Field of Search ..... 215/214, 216, 217, 218, 215/222

[56] References Cited

U.S. PATENT DOCUMENTS

| | | | |
|---|---|---|---|
| 3,339,770 | 9/1967 | Weigand | 215/214 |
| 3,880,314 | 4/1975 | Akers | 215/222 |
| 3,984,021 | 10/1976 | Uhlig | 215/217 |
| 4,091,948 | 5/1978 | Northup | 215/222 |
| 4,270,664 | 6/1981 | Buono | 215/217 XV |

*Primary Examiner*—George T. Hall

*Attorney, Agent, or Firm*—Charles F. Costello, Jr.

[57] ABSTRACT

A locking means for a threaded container and closure has been invented. The locking means comprises A. a container having a neck portion; and on the external surface of said neck portion
   I. a continuous first thread;
   II. a ring adjacent the terminal end of said thread;
   III. and at least one lug having
      a contacting surface diagonally aligned with said first thread; an upper surface adjacent to or lower than said ring; and a height and radial thickness greater than said ring;

B. a closure having
   I. a radially flexible inner flange, the terminal end of said inner flange coordinating with the internal surface of said neck; and
   II. an outer flange having
      a continuous second thread coordinating with said first thread; and at least one tab adjacent the initial end of said second thread whereby said closure is threaded onto said container, said tab passes onto said contacting surface and is then engaged by the terminal surface of said lug.

9 Claims, 10 Drawing Figures

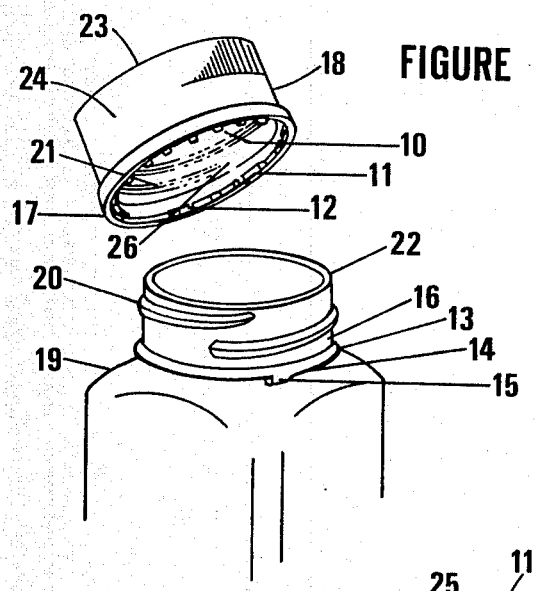
FIGURE 1
FIGURE 2
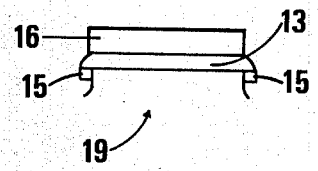
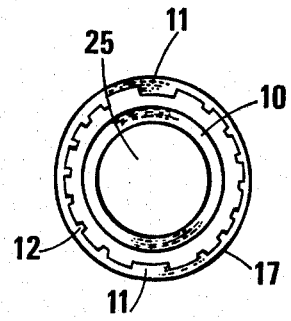
FIGURE 3
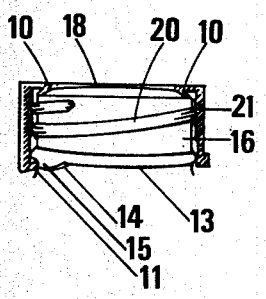
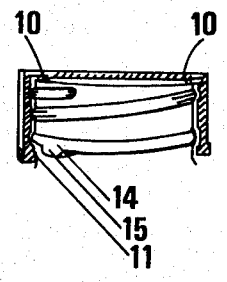
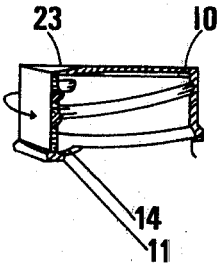
FIGURE 4 FIGURE 5 FIGURE 6

CHILD RESISTANT CLOSURE DEVICE

BACKGROUND AND SUMMARY OF THE INVENTION

This invention relates to a locking means for a threaded container and closures. More specifically, this invention relates to a child-resistant locking means.

A problem of great concern in recent years has been the safety of children who can open a closed container. The prior art has suggested many solutions for securing a closure on a container, while still permitting a relatively easy opening by the intended user.

A locking means for a threaded container and closure has been invented. The locking means comprises A. a container having a neck portion; and on the external surface of said neck portion
   I. A continuous first thread;
   II. a ring adjacent the terminal end of said thread;
   III. and at least one lug having
      a contacting surface diagonally aligned with said first thread; an upper surface adjacent to or lower than said ring; and a height and radial thickness greater than said ring;

B. a closure having
   I. a radially flexible inner flange, the terminal end of said inner flange coordinating with the internal surface of said neck; and
   II. an outer flange having
      a continuous second thread coordinating with said first thread; and at least one tab adjacent the initial end of said second thread whereby said closure is threaded onto said container, said tab passes onto said contacting surface and is then engaged by the terminal surface of said lug.

Other embodiments of the locking means comprise wherein the external surface of said neck portion has a stop having an upper surface adjacent to said lug whereby the initial surface of said stop coordinates with the initial surface of said tab; wherein the diameter of upper neck portion is greater than the diameter of the lower neck portion; wherein a locking means contains at least two lugs and tabs; wherein said lugs and said tabs, respectively, are equidistant; wherein said lug is located about 180° from the initial end of said first thread; wherein said container is composed of a polyolefin material; wherein said closure is composed of a polyolefin material; and wherein said polyolefin material is polypropylene.

BRIEF DESCRIPTION OF THE DRAWINGS

FIG. 1 is a perspective view of a threaded container and closure of this invention;

FIG. 2 is a side view of the container of FIG. 1 showing the ring and container lugs;

FIG. 3 is a bottom view of the closure of FIG. 1 showing the inner and outer flanges and closure tabs.

FIGS. 4 to 6 are schematic side views showing the locking means of this invention in an engaged, neutral and disengaged position, respectively.

DESCRIPTION OF THE PREFERRED EMBODIMENT

Figure 8:
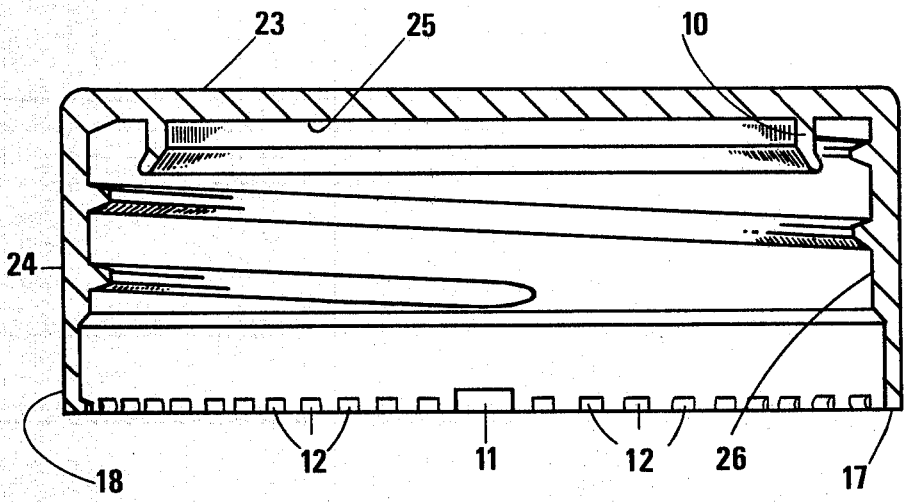
FIG. 8 is a center sectional side view of the closure of FIG. 1.

Referring to FIGS. 1 to 3, a container body 19 has a neck portion 16. The neck portion 16 includes an annular transfer ring 13. The neck portion 16 terminates in an open rim 22.

The neck portion 16 also has a continuous first thread 20 formed on the external surface. The transfer ring 13 has formed thereon, at least one holding lug 15 with a contacting surface 14.

The closure 18 includes: an outer top 23, an outer flange external wall 24, an inner top 25 which has formed on its surface a resilient inner flange 10. An outer flange internal wall 26 has formed on its surface a continuous second thread which coordinates with the first thread 20. The outer flange rim 17 includes around the internal edge at least one locking tab 11 and a plurality of optional friction tabs 12. The tabs 11 correspond to the number of lugs 15 on the transfer ring 13. The optional tabs 12 are spaced between the locking tab(s) 11 and can be an audible indicator of the locking engagement and/or reinforcing structural ribs to the closure rim 17.

The locking tab(s) 11 are located with respect to the lug(s) 15 on the transfer ring.

Figure 9:
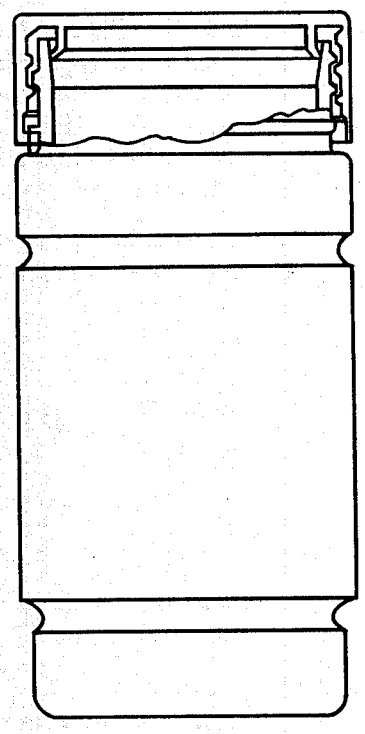
FIGS. 9 and 10 are schematic side views showing the locking means of this invention in an engaged and neutral position, respectively.

The closure is completely threaded onto the container. The locking means is then engaged as illustrated in FIG. 4. The closure 18 is completely engaged with the neck 16. The terminal end of the resilient inner flange 10 presses against the internal surface of the neck 16. FIGS. 4 and 9 show that the locking tab(s) 11 is engaged by the lug(s) 15. The locking tab(s) 11 is rotated onto the contacting surface 14 as the closure is threaded onto the container and is then engaged by the lug(s) 15.

Disengagement of the closure from the container is prevented by the locking means due to the abutting of the tab(s) 11 and lug(s) 15. A conventional rotation of the closure 3*g* in a counterclockwise direction is not possible.

Figure 10:
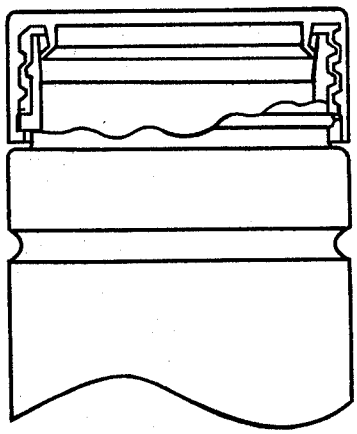

The locking means is a neutral position alternatively illustrated in FIGS. 5 and 10. The disengagement of the locking means and the removal of the closure from the container is illustrated in FIG. 6. Instructions for disengaging the locking means can be optionally contained on the closure and/or the container, e.g. on the outer top 23. The locking means are neutralized by pressing on the outer top 23 in a vertically downward direction. Downward movement of the closure is permitted by the radially flexible inner flange 10.

Referring to FIG. 5, the tab(s) 11 and lug(s) 15 are sufficiently vertically displaced to allow them to move past each other during a conventional rotation of the closure. The vertical pressure is applied to the closure during conventional rotation until the tab(s) 11 is opposing the contacting surface 14. Preferably, the vertical pressure is applied until the locking tab(s) 11 are above the upper surface of the holding lug 15. Continued conventional rotation of the closure results in separation of the container and closure, allowing the closure to be removed and providing access to the interior of the container for dispensing of the contents.

Figure 7:
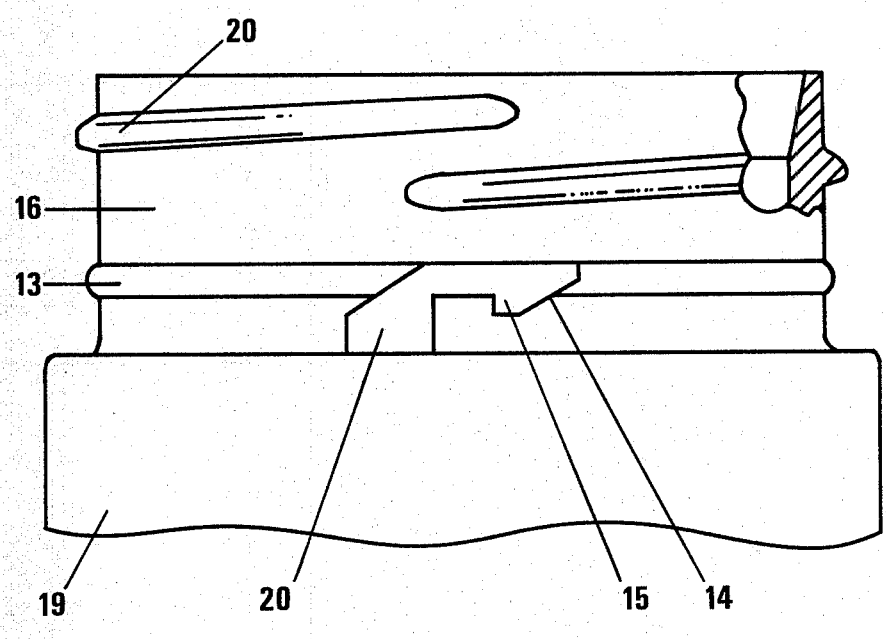
FIG. 7 is a side view of the container showing a continuous first thread, a ring and an alternative lug.

Referring to FIGS. 7 and 8, a container body 19 has a neck portion 16. The neck portion 16 includes an annular transfer ring 13.

The neck portion 16 also has a continuous first thread 20 formed on the external surface. The transfer ring 13 has formed thereon, at least one holding lug 15 with a contacting surface 14. On the external surface of the neck portion a stop 20 has an upper surface adjacent to the upper surface of the lug 15. The initial surface of the stop 20 coordinates with the initial surface of the tab 11.

The closure 18 includes: an outer top 23, an outer flange external wall 24, an inner top 25 which has formed on its surface a resilient inner flange 10. An outer flange internal wall 26 has formed on its surface a continuous second thread which coordinates with the first thread 20. The outer flange rim 17 includes around the internal edge at least one locking tab 11 and a plurality of optional friction tabs 12. The tabs 11 correspond to the number of lugs 15 on the transfer ring 13. The optional tabs 12 are spaced between the locking tab(s) 11 and can be an audible indicator of the locking engagement and/or reinforcing structural ribs to the closure rim 17.

We claim:

1. A locking means for a threaded container and closure comprising

A. a container having a neck portion; and on the external surface of said neck portion I. a continuous first thread;

II. a ring adjacent the terminal end of said thread;

III. and at least one lug having a. a contacting surface diagonally aligned with said first thread;

b. an upper surface adjacent to or lower than said ring; and c. a height and radial thickness greater than said ring;

B. a closure having

I. a radially flexible inner flange, the terminal end of said inner flange coordinating with the internal surface of said neck; and II. an outer flange having a. a continuous second thread coordinating with said first thread; and b. at least one tab adjacent the initial end of said second thread whereby said closure is threaded onto said container, said tab passes onto said contacting surface and is then engaged by the terminal surface of said lug.

2. A locking means of claim 1 wherein the external surface of said neck portion has a stop having an upper surface adjacent to said lug whereby the initial surface of said stop coordinates with the initial surface of said tab.

3. A locking means of claim 1 or 2 wherein the diameter of upper neck portion is greater than the diameter of the lower neck portion.

4. A locking means of claim 1 or 2 or 3 containing at least two lugs and tabs.

5. A locking means of claim 4 wherein said lugs and said tabs, respectively, are equidistant.

6. A locking means of claim 1 or 2 or 3 wherein said lug is located about 180° from the initial end of said first thread.

7. A locking means of claim 1 or 2 or 3 or 6 wherein said container is composed of a polyolefin material.

8. A locking means of claim 1 or 2 or 3 or 6 wherein said closure is composed of a polyolefin material.

9. A locking means of claim 7 or 8 wherein said polyolefin material is polypropylene.

* * * * *